US005293743A

United States Patent [19]

Usleman et al.

[11] Patent Number: 5,293,743

[45] Date of Patent: Mar. 15, 1994

[54] LOW THERMAL CAPACITANCE EXHAUST PROCESSOR

[75] Inventors: Robert T. Usleman; Mark A. Sickels, both of Columbus, Ind.

[73] Assignee: Arvin Industries, Inc., Columbus, Ind.

[21] Appl. No.: 886,955

[22] Filed: May 21, 1992

[51] Int. Cl.[5] ..... F01N 3/28

[52] U.S. Cl. ..... 60/299; 60/322; 422/179; 422/180

[58] Field of Search ..... 60/299, 322; 422/179, 422/180

[56] References Cited

U.S. PATENT DOCUMENTS

| | | | |
|---|---|---|---|
| 3,902,853 | 9/1975 | Marsee | 422/172 |
| 3,972,687 | 8/1976 | Frietzsche | 422/180 |
| 3,984,207 | 10/1976 | Abthoff | 422/179 |
| 4,160,010 | 7/1979 | Öttle | 422/180 |
| 4,335,077 | 6/1982 | Santiago | 422/180 |
| 4,775,518 | 10/1988 | Abthoff | 422/179 |
| 5,173,267 | 12/1992 | Maus et al. . | |
| 5,190,732 | 3/1993 | Maus | 422/179 |

FOREIGN PATENT DOCUMENTS

| | | | |
|---|---|---|---|
| 3430398 | 2/1986 | Fed. Rep. of Germany | 422/180 |

*Primary Examiner*—Douglas Hart
*Attorney, Agent, or Firm*—Barnes & Thornburg

[57] ABSTRACT

An exhaust processor assembly includes an exhaust pipe and a substrate for treating emissions contained in combustion product emitted from an engine exhaust. The assembly also includes a second pipe for providing a passageway receiving combustion product and the substrate means is positioned in the passageway to treat emissions passed therethrough. The assembly further includes an apparatus for positioning the second pipe in the interior region of the exhaust pipe so that thermal transfer between the substrate and the second pipe is minimized in order to maximize retention of thermal energy by the substrate resulting from the combustion product traveling through the passageway.

17 Claims, 3 Drawing Sheets

LOW THERMAL CAPACITANCE EXHAUST PROCESSOR

BACKGROUND AND SUMMARY OF THE INVENTION

The present invention relates to exhaust processors for treating emissions from combustion product produced by an engine, and particularly to an apparatus for rapidly heating a catalytic converter or other exhaust processor to its minimum operating temperature at the beginning of a cold start cycle of an engine. More particularly, this invention relates to an exhaust processor including a catalyzed substrate and a substrate housing configured to use hot combustion product to heat the catalyzed substrate quickly.

For environmental reasons, engine exhaust must be cleaned on board a vehicle before it is expelled into the atmosphere. This processing is accomplished by passing the untreated combustion product produced by the engine through an exhaust processor to minimize unwanted emissions.

Catalytic converters are well-known exhaust processors and are used to purify contaminants from hot combustion product discharged from an engine exhaust manifold. Within a catalyzed exhaust processor, the combustion product is treated by a catalyzed ceramic or metal substrate which converts the exhaust gases discharged from the engine primarily into carbon dioxide, nitrogen, and water vapor. The catalytic converter treats engine combustion product to produce an exhaust stream meeting stringent state and federal environmental regulations and emissions standards. After processing, the treated combustion product is then routed to a muffler to attenuate the noise associated with the combustion. It is also known to provide exhaust processors that include substrates that function as particulate traps to filter contaminant particulates without using a catalyst.

Exhaust processors are known in the prior art. See, for example, U.S. Pat. No. 4,969,264 to Dryer et al.; U.S. Pat. No. 3,159,239 to Andrews; U.S. Pat. No. 4,087,039 to Balluff; U.S. Pat. No. 4,519,120 to Nonnenmann et al.; and European patent No. 0 243 951 to Kanniainen.

Typically, hot combustion product is conducted through a pipe mounted under the body of a vehicle between an engine and a remote exhaust processor. The temperature of the combustion product decreases somewhat during this journey. At the beginning of a cold start cycle of an engine, the exhaust processor is "cold" and typically has a temperature that is about equal to the temperature of the surroundings. Over time, the combustion product produced by a cold-started engine, being at an elevated temperature, heats the substrate and housing in the exhaust processor to a high temperature. This heating is desirable if the substrate is catalyzed because a catalyzed substrate works to purify contaminants from engine combustion product most efficiently at high temperatures.

A catalyzed substrate purifies contaminants from engine combustion product most efficiently at high temperatures. However, a catalyzed substrate does not actively and efficiently treat combustion product until it is heated to a minimum operating temperature during the initial moments of an engine cold start cycle. A catalytic converter is said to "light off" when it is heated to its minimum operating temperature and begins to purify combustion product in an effective manner.

A substantial reduction in tail pipe emissions measured using the Federal Test Procedure can be realized by minimizing the elapsed time between engine ignition and catalytic converter light off during an engine cold start cycle. The majority of total emissions occurs during the cold start portion of the Federal Test Procedure before the catalytic converter has been heated to reach its minimum operating temperature. Accordingly, vehicle emissions can be reduced by achieving faster light off of the catalytic converter at the beginning of an engine cold start cycle.

With respect to the above-noted problem, U.S. Pat. No. 4,731,993 to Ito et al discloses a rear exhaust manifold having thick walls and a front exhaust manifold made of a thin stainless steel plate so that the front exhaust manifold has walls thinner than the walls of the rear exhaust manifold. It is also known from U.S. Pat. No. 5,018,66 to Cyb to apply a thin layer of heat-resistant compound to the interior of an exhaust manifold and from U.S. Pat. No. 5,004,018 to Bainbridge to provide an insulated exhaust pipe including inner and outer spaced tubes separated by refractory fiber insulation. Systems using electrically heated catalytic converters and catalytic converters containing increased amounts of precious metals are also known.

There is a need to improve vehicle emission controls to meet increasingly stringent emission standards. An exhaust system configured to provide quicker light off of the catalytic converter using heat energy contained in the hot combustion product produced by an engine would be an improvement over conventional exhaust systems.

Conventional exhaust processors typically use either heavy gauge metal clamshells welded together or a heavy gauge metal can with heavy gauge metal cones welded to each end to provide housings supporting catalyzed substrates. Because of the heavy gauge metal structure, conventional substrate housings and support structures have a high "thermal capacitance". That is, the heat energy storage capability of these conventional housings and structures per unit length is quite large and they act as large heat sinks during the initial moments of an engine cold start cycle.

As a result of the high thermal capacitance of the conventional substrate housings and support structures, a large portion of the heat energy from the combustion product is consumed in heating the heavy gage substrate housings and support structures. By allowing heat energy from the combustion product to be diverted to the substrate housing and support structure, less heat energy is available to heat the substrate to its minimum operating temperature. Consequently, it takes longer to heat the catalyzed substrate to its minimum operating temperature at the beginning of a cold start cycle of an engine.

It would therefore be desirable to reduce the amount of heat energy used to heat a substrate housing and support structure during the initial moments of an engine cold start cycle to raise the temperature of the substrate to reach its minimum operating temperature in less time. Tail pipe emissions would be reduced if the substrate in an improved exhaust processor reached its minimum operating temperature at an earlier point during an engine cold start cycle.

Conventional exhaust processors are known to radiate large amounts of heat to the area surrounding the exhaust processor. Various shielding designs are typically used to protect objects in the surrounding area from the heat generated by the exhaust processor. Generally, conventional exhaust processor shields include flanges at a clamshell split line to permit the shields to be attached to each other and surround the exhaust processor. However, the flanges cause a processor location problem because it is necessary to provide a larger clearance envelope around the processor to accommodate large flanges. Therefore shielding or insulating the processor without significantly increasing the size of the processor would be an improvement over conventional exhaust processors.

According to the present invention, an exhaust processor assembly comprises an outer shell formed to include an interior region and an inner shell extending into the interior region. The exhaust processor assembly includes substrate means for treating emissions contained in combustion product emitted from an engine. The inner shell includes means for positioning the substrate means inside the interior region of the outer shell so that the substrate means is positioned in spaced-apart relation to the outer shell to minimize thermal transfer between the substrate means and the outer shell.

In preferred embodiments, the positioning means includes a thin-walled sleeve and the substrate means is retained in this thin-walled sleeve to lie in spaced-apart relation to the outer shell. The thin-walled sleeve desirably has a low thermal capacitance of less than 12,200

$$\frac{J}{m^2 \cdot K}$$

so it does not act as a significant heat sink to divert heat energy in the combustion product away from the substrate means at the beginning of an engine cold start cycle. Also, the thin-walled sleeve positions the substrate means in spaced-relation to the outer shell to minimize diversion of heat energy in the combustion product to the more massive outer shell. Advantageously, the outer shell is configured to protect and support the thin-walled sleeve and substrate means without absorbing a lot of heat from combustion product at engine start up.

By providing an outer shell for structural strength, the present invention allows the use of a thin-walled inner shell. This low thermal capacitance thin-walled inner shell provides an improvement over conventional exhaust processors in that it causes the substrate in the exhaust processor to be heated to its minimum operating temperature and light off more rapidly at the beginning of a cold start cycle of the engine. Consequently, the substrate is active to lower total vehicle emissions without resorting to complex exhaust control mechanisms, costly exhaust system materials, or electrically preheated substrates. Essentially, the low thermal capacitance thin-walled inner shell conserves the heat energy already available in the hot combustion product discharged by the engine and uses that heat energy to effectively light off the substrate very early in the cold start cycle of an engine and reduce total emissions and resulting pollution.

The present invention represents another improvement over conventional processors by providing an insulated exhaust processor. The present invention positions an insulating air gap between the inner and outer housing which obviates the need for shielding, thereby allowing a smaller clearance envelope while actually reducing the amount of heat given off by the exhaust processor.

Additional objects, features, and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
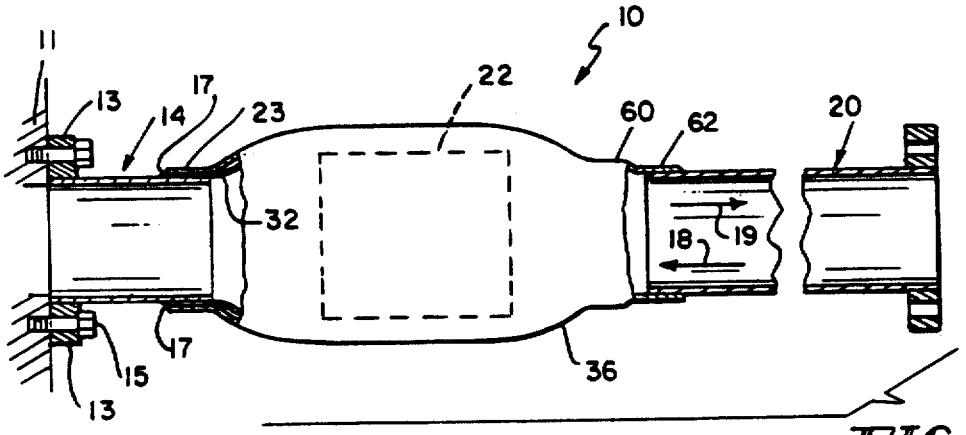
FIG. 1 is a side elevation of an exhaust processor in accordance with the present invention with portions broken away to show the connection of the exhaust processor at an inlet end to an engine and at an outlet end to an outlet exhaust pipe.

The present invention provides an exhaust processor 10, generally shown in FIG. 1, for treating emissions from combustion product discharged by an engine 11. Combustion product 12 discharged from engine 11 travels through an inlet pipe 14 which is mounted to the engine 11 by a flange 13 held in place by bolts 15, to arrive at the processor inlet 16 for processing. After processing, the treated combustion product 19 leaves the processor 10 via the processor outlet 18, where it enters an exhaust pipe 20 and is conducted to downstream exhaust system components, and then released to the atmosphere. The inlet pipe 14 and the exhaust pipe 20 are attached to the processor 10 by conventional means such as welding 17.

The processor 10 treats emissions contained in combustion product 12 emitted from an engine 11 by passing the untreated combustion product 12 through a catalyzed substrate 22. The substrate 22, which can be metallic or ceramic, is housed in a thin-walled inner shell 24 made from thin gauge sheet metal to minimize the thermal capacitance of the substrate support structure. This allows more thermal energy in the combustion product 12 to reach the substrate 22 during vehicle start up, causing it to heat up faster to its minimum operating temperature. Therefore, the catalyst on the substrate 22 begins to process combustion product 12 in a shorter period of time, to lower the overall vehicle emissions. At the same time, the thin-walled inner shell 24 thermally isolates an outer shell 36 surrounding the inner shell 24 from the heat of the combustion product 12. By thermally isolating the outer shell 36, the thin wall construction of the inner shell 24 in the present invention also allows the use of thinner and less expensive sheet metal for the outer shell 36 and thereby reduces material cost. Relative movement between the inner shell 24 and outer shell 36, caused by differential thermal expansion, is provided for at the processor outlet 60.

Preferably, the thin-walled inner shell 24 has a thermal capacitance per unit length per unit diameter of less than 12,200

$$\frac{J}{m^2 \cdot K}.$$

Because of its low thermal capacitance, thin-walled inner shell 24 does not act as a significant heat sink to divert heat energy in the combustion product passing through thin-walled inner shell 24 at the beginning of a cold start cycle of engine 11. The thermal capacitance of a material is the product of the volume, density, and specific heat of the material.

Illustratively, thin-walled inner shell 24 is made of type 439 (AISI) stainless steel which has a density of $$7695 \frac{kg}{m^3}$$

and a specific heat of $$460 \frac{J}{kg \cdot K}.$$

Further, the illustrative thin-walled inner shell 24 has a wall thickness of 0.46 mm (0.018 inch). Such a thin-walled inner shell 24 has a thermal capacitance per unit length per unit diameter of $$5{,}100 \frac{J}{m^2 \cdot K}.$$

A thin-walled inner shell (not shown) that is made of type 439 (AISI) stainless steel and has a wall thickness of 1.10 mm (0.043 inch) would have a thermal capacitance per unit length per unit diameter of $$12{,}200 \frac{J}{m^2 \cdot K}.$$

Other suitable thin-walled pipe materials include, for example, any material suitable for the high temperature, corrosive environment of an automotive exhaust system.

Figure 6:
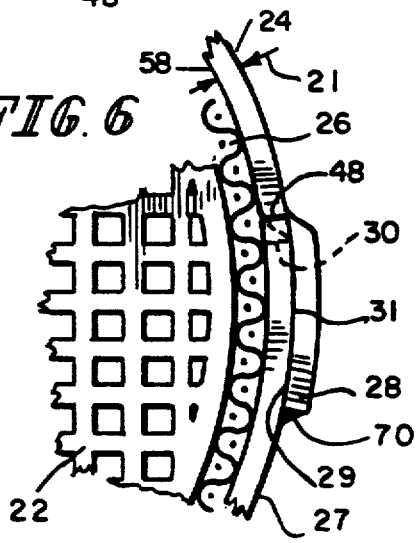
FIG. 6 is an enlarged view of the thin-walled inner shell shown in FIG. 5 showing the mating tab and notch in greater detail.
Figure 7:
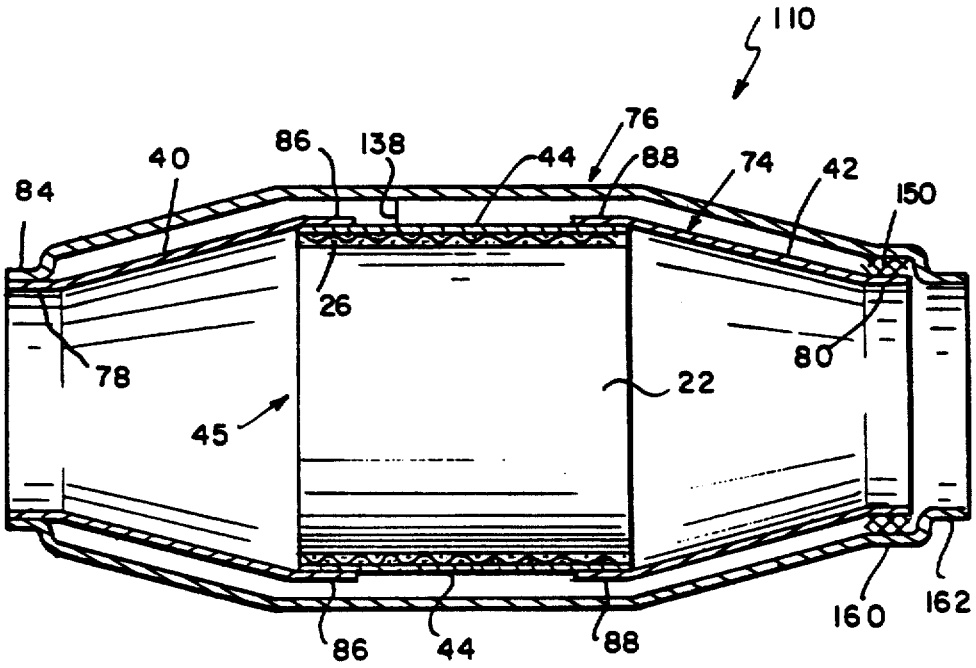
FIG. 7 is a longitudinal sectional view of a preferred embodiment of an exhaust processor showing the use of an inlet cone, sleeve, and outlet cone to support a substrate inside an outer shell.
Figure 8:
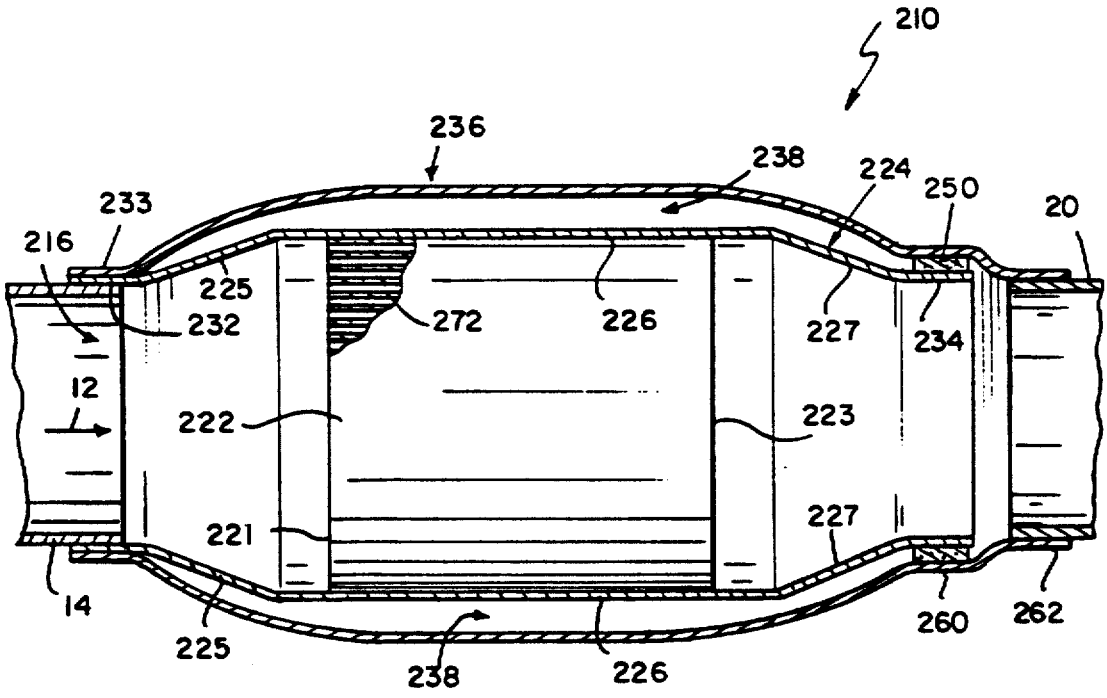
FIG. 8 is a longitudinal sectional view of a preferred embodiment of an exhaust processor showing the use of a metallic substrate brazed into a long thin-walled inner shell.

One embodiment of the invention is illustrated in FIGS. 2–6 and a second embodiment is illustrated in FIG. 7. A presently preferred embodiment including a metallic substrate is illustrated in FIG. 8. A thin-walled inner shell having a low thermal capacitance is needed in each of these embodiments to minimize dissipation of heat energy during the early stages of an engine cold start cycle.

Figure 3:
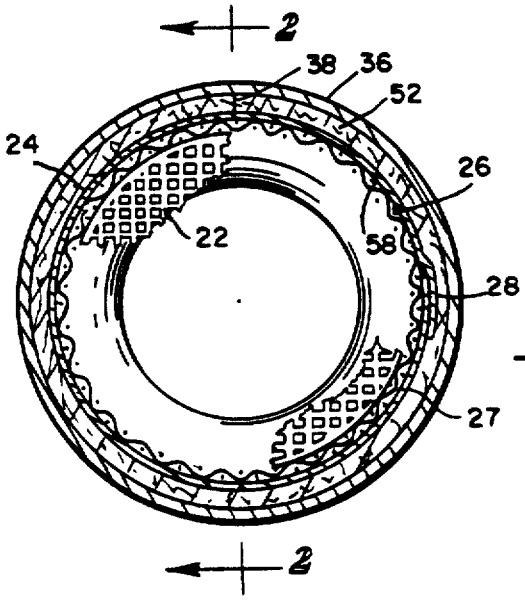
FIG. 3 is a transverse section of the exhaust processor taken along section line 3—3 of FIG. 2 showing the spatial relationship between the inner and outer shell with insulation therebetween, the substrate and the mat mount material around the substrate.
Figure 2:
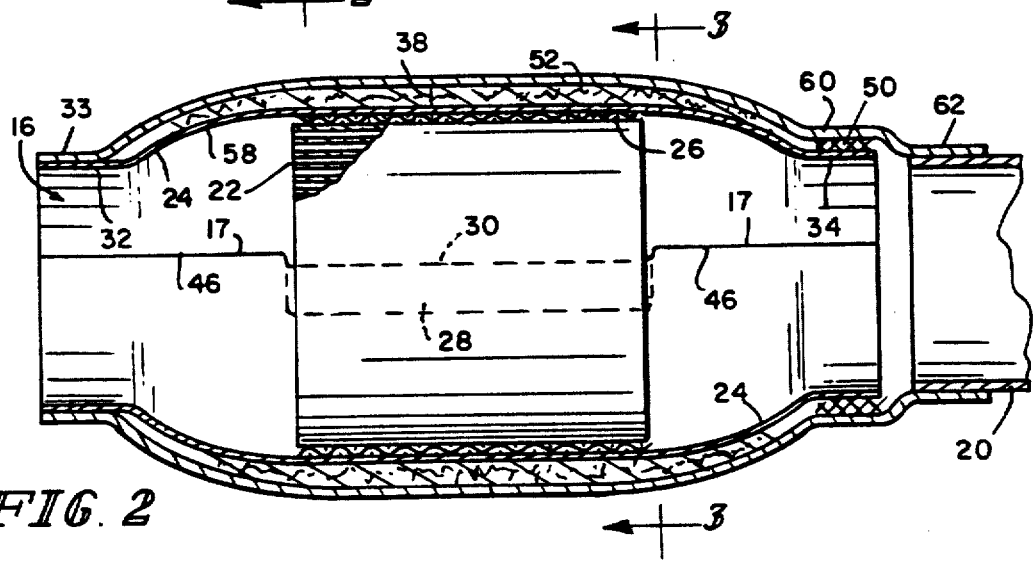
FIG. 2 is a longitudinal section of the exhaust processor of FIG. 1 taken along the section line 2—2 of FIG. 3 showing a substrate mounted in a thin-walled inner shell and an outer shell forming a dead air space or a space filled with insulation around the inner shell.
Figure 4:
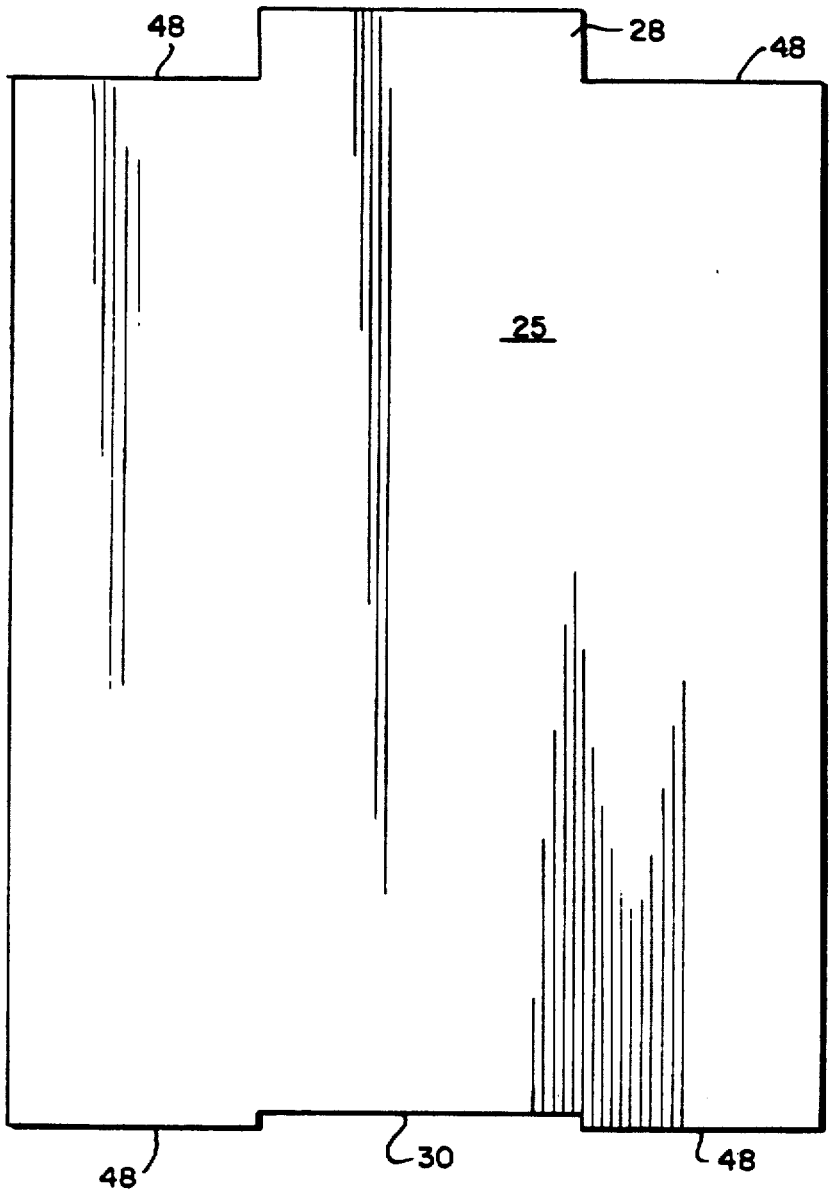
FIG. 4 is a plan view of a sheet of material formed to include a notch at one end and a tab at the other end prior to rolling or otherwise forming the sheet of material to produce the thin-walled inner shell shown in FIGS. 2 and 3.
Figure 5:
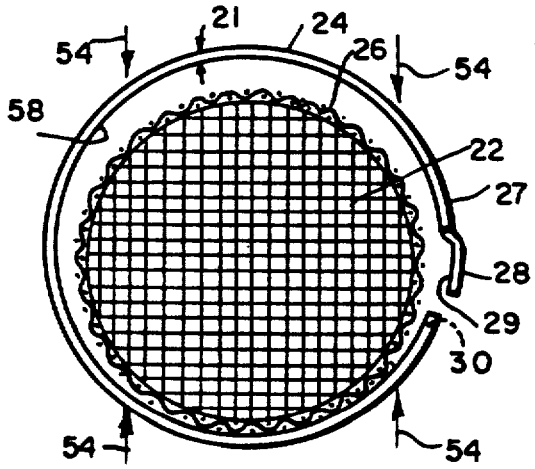
FIG. 5 shows an illustrative forming technique wherein a sheet of material can be wrapped around the substrate to produce the thin-walled inner shell.

Within the thin-walled inner shell 24 shown in FIGS. 2 and 3, the substrate 22 is surrounded by an annular, shock absorbent, resilient, and insulative mat mount support material 26, which is preferably formed of a gas impervious material that expands substantially when heated. The thin-walled inner shell 24 has an inlet end 32 and an outlet end 34. The thin-walled inner shell 24 is illustratively fabricated from a sheet of thin gauge metal 25 which is formed to include a tab 28 at one end and a notch 30 at the other end as shown in FIG. 4. As shown illustratively in FIG. 5, the metal sheet 25 is rolled or otherwise shaped nearly to form a cylinder. The substrate 22 and mat mounting material 26 are then inserted in a suitable manner into the rolled metal sheet 25, and the metal sheet 25 is closed around the substrate 22 and mat mount material 26, as indicated by arrows 54, to form the cylindrical thin-walled inner shell 24.

When the rolled metal sheet 25 is closed, the tab 28 formed on one end of metal sheet 25 engages in the notch 30 formed in the opposite end of the metal sheet 25, so that the inner surface 29 of the tab 28 lies adjacent to and in contact with a portion 31 of the outer surface 27 of the inner shell 24 as shown in FIG. 6. The mating edges 48 abut each other to form an axially extending seam 46 shown in FIG. 2. An illustrative fillet weld 70 is provided along the edge of the tab 28 and the outer surface 27 of the inner shell 24 and an illustrative butt weld 17 along the remainder of the seam 46 is provided to maintain the inner shell 24 in a closed position, thereby pressing the inner surface 58 of the thin-walled inner shell 24 against the mat mount material 26 to hold the substrate 22 in position within the inner shell 24. The inlet end 32 and outlet end 34 of the inner shell 24 are sized down using conventional techniques to provide means for attaching the thin-walled inner shell 24 to an inlet pipe 14 and to the mesh seal ring 50.

The processor 10 also includes an outer shell 36 surrounding the thin-walled inner shell 24 as shown best in FIG. 2. The outer shell 36 is made of a sturdy material such as type 409 (AISI) stainless steel and has a wall thickness of 1.4 mm (0.055 inch). Preferably, the wall thickness of the outer shell 36 is greater than 1.10 mm (0.043 inch). The outer shell 36 could alternatively be made of other materials such as any material suitable for the high temperature, corrosive environment of an automotive exhaust system.

The outer shell 36 serves primarily as a structural support and shield for thin-walled inner shell 24. Although the annular air gap inside the outer shell 36 along and around the thin-walled inner shell 24 does provide a layer of insulation between the thin-walled inner shell 24 and the outer shell 36, this air gap is effective to minimize heat loss from the hot combustion product passing through thin-walled inner shell 24 only after engine ii has warmed up and steady-state heat-transfer conditions have developed, not during a cold start when transient heat transfer conditions prevail. Testing has established that no matter how the outside of thin-walled inner shell 24 is insulated (air gap or otherwise), the key to reducing the light off time of the substrate 22 in the exhaust processor 10 is to minimize the thermal capacitance of the thin-walled inner shell 24 in accordance with the present invention.

Outer shell 36 also provides a structural means for permitting the processor 10 to be connected to the inlet pipe 14 and the exhaust pipe 20, typically by welding or clamping. At the same time, outer shell 36 protects the thin-walled inner shell 24 from corrosive effects of the outside atmosphere. Furthermore, outer shell 36 functions to thermally isolate the thin-walled inner shell 24, thereby helping to minimize thermal gradients in the substrate 22 which increase its durability.

The outer shell 36 includes an inlet 33 that is sized down to surround and mate with the inlet 32 of the thin-walled inner shell 24. The inner shell 24 is thereby cantilevered inside the outer shell 36. The inner shell 24 and outer shell 36 are illustratively welded together 17 at the processor inlet 16 to form an axially extending air gap 38 therebetween as shown best in FIG. 2. A resilient seal ring 50 of the type commonly used in production resonator construction, is inserted between the inner and outer shells 24, 36 at outlet 34 of the inner shell 24. An example of this type of ring is a wire mesh seal ring called a NAVIN ring. The ring 50 allows for thermal growth between the inner and outer shells 24, 36 while still allowing the outer shell 36 to support the low thermal capacitance, thin-walled inner shell 24. The seal ring 50 provides adequate support for the cantilevered inner shell 24 without generating noise or causing galling of the metal surfaces of shells 24, 36 during heat up and cool down. Unwanted galling might otherwise occur when the outer shell 36 supports the inner shell 24 directly, as in the case where the outer shell 36 is sized down directly onto the inner shell 24. The seal ring 50 could also be made of an insulating material to further thermally isolate the inner shell 24 from the outer shell 36.

Insulating/support material 52 can be inserted in the air gap 38 formed between the inner and outer shells 24, 36, if desired as shown in FIGS. 2 and 3. This material 52 increases the insulating capability of the processor 10 and provides additional support between the inner and outer shells 24, 36. The air gap 38 and the insulation/-support material 52 are isolated from the atmosphere by multiple sizings of the exhaust end 60, 62 of the outer shell 36 which reduce the inner diameter thereof to match the outer diameter of an exhaust pipe 20, and therefore prevent wicking (absorption of water) by the insulation 52, thereby extending the useful life of the processor 10.

The multiple sizings at the exhaust end of outer shell 36 can be accomplished as follows. For example, the outer shell 36 has a first exhaust sized portion 60 and a second exhaust sized portion 62. The first sized portion 60 is sized down coaxially with the outlet 34 of the thin-walled inner shell 24 to engage the seal ring 50. Downstream from the first exhaust sized portion 60, relative to exhaust gas flow through the exhaust processor 10, the outer shell 36 is sized down at the second sized portion 62. The inner diameter of the second sized portion 62 of the outer shell 36 is equal to the inner diameter of the sized outlet 34 of the inner shell 24.

The exhaust processor 10 has a thin-walled inner shell 24 having a wall thickness of less than 1.10 mm (0.043 inch) to reduce the thermal capacitance of the inner shell 24 as compared to a conventional exhaust processor (not shown). After "cold starting" the engine, the lower thermal capacitance results in a higher rate of temperature increase of the combustion product 12 at the inlet end 32 of the inner shell 24. The processor 10, then, reaches operating temperatures or "lights off" more quickly than a conventional processor (not shown). Quicker light off of the processor 10 results in a substantial reduction in tail pipe emissions measured using the Federal Test Procedure (FTP). Light off is very important because the majority of the total emissions typically occurs during the cold start portion of the test before the exhaust processor has reached its minimum operating temperature.

In another illustrative embodiment of the invention shown in FIG. 7, a thin-walled inner shell 74 includes thin-walled cones 40, 42 attached to a thin-walled sleeve 44. The cones 40, 42 are sized to form an inner shell inlet 78 and an inner shell outlet 80, respectively, which provide mating surfaces for an inlet pipe (not shown) and a seal ring 150, respectively. Flanges 86, 88 are formed on cones 40, 42, respectively. The flanges 86, 88 are attached to the thin-walled sleeve 44 by welding or other suitable means to form the thin-walled inner shell 74. The substrate 22 and mat mount 26 are housed inside the interior region of the thin-walled sleeve 44 as shown in FIG. 7.

A substrate sub-assembly 45 is constructed in a fashion similar to that depicted in the embodiments of FIGS. 1–6 so that it lies inside thin-walled sleeve 44. The substrate 22 is surrounded by a mat mount material 26 which is compressed into position by forming a metal sheet to produce a nearly cylindrical sleeve (not shown), inserting the substrate 22 and the mat mount material 26 therein, and welding the sleeve in a closed formation to produce the substrate sub-assembly 45.

The outer shell inlet 84 is sized down to mate with the thin-walled cones 40, 42 so as to align the longitudinal axis of the outer shell 76 with the longitudinal axis of the inner shell 74, and to provide a circumferential seal about the inner shell inlet 78. A wire mesh seal ring 150 is mounted to the inner shell outlet 80.

The outer shell 76 has a first exhaust opening 160 and a second exhaust opening 162. The first exhaust opening 160 is sized down coaxially with the inner shell outlet 80 to engage the seal ring 150, thereby forming an air gap 138 between the inner shell 74 and the outer shell 76. Downstream from the first exhaust opening 160, relative to exhaust gas flow through the exhaust processor 110, the outer shell 76 is sized down at a second exhaust opening 162. The inner diameter of the second exhaust opening 162 of the outer shell 76 is equal to the outer diameter of an exhaust pipe, and they are attached by conventional means such as welding.

A preferred embodiment of a low thermal capacitance processor 210 is shown in FIG. 8. This processor 210 includes a metallic substrate 222 brazed into a thin-walled inner shell 224. Preferably, shell 224 is a thin-walled cylindrical tube. The thin-walled inner shell 224 is considerably longer than the substrate 222, so that the inlet and 232 and the outlet end 234 of the inner shell 224 extend well beyond the inlet and outlet faces 221, 223 of the metallic substrate 222. The inlet end 232 and the outlet end 234 are sized down using conventional metal-forming techniques to provide means for attaching the thin-walled inner shell 224 to an inlet pipe 14 and to the mesh seal ring 250.

The substrate 222 is constructed of thin foil layers 272 coated with a washcoat and catalyst. The thin foil layers 272, preferably 0.001–0.004 inches (0.005–0.010 cm), are fixed within the thin-walled inner shell 224 as, for example, by brazing. Advantageously, brazing allows the metallic substrate 222 to be permanently fixed to the inner shell 224 without the need for other means for retaining the substrate 222 in place inside the inner shell 224. Furthermore, since the substrate 222 is metallic, there is no need to install a shock absorbing material between the substrate 222 and the inner shell 224, thereby providing a manufacturing cost savings.

The thin-walled inner shell 224 has a wall thickness of less than 1.10 mm (0.043 inch) to reduce the thermal capacitance of the inner shell 224 as compared to a conventional exhaust processor (not shown). After "cold starting" the engine, the lower thermal capacitance results in a higher rate of temperature increase of the combustion product 12 at the inlet end 232 of the inner shell 224. The processor 210, then, reaches operating temperatures or "lights off" more quickly than a conventional processor (not shown).

The processor 210 also includes an outer shell 236 surrounding the thin-walled inner shell 224. The outer shell 236 is made of a sturdy material such as type 409 (AISI) stainless steel and has a wall thickness of 1.4 mm (0.055 inch). Preferably, the wall thickness of the outer shell 236 is greater than 1.10 mm (0.043 inch). The outer shell 236 could alternatively be made of other materials such as any material suitable for the high temperature, corrosive environment of an automotive exhaust system.

The outer shell 236 serves primarily as a structural support and shield for thin-walled inner shell 224. Although the annular air gap 238 inside the outer shell 236 along and around the thin-walled inner shell 224 does provide a layer of insulation between the thin-walled inner shell 224 and the outer shell 236, this air gap 238 is effective to minimize heat loss from the hot combustion product passing through thin-walled inner shell 224 only after engine 11 has warmed up and steady-state heat-transfer conditions have developed, not during a cold start when transient heat transfer conditions prevail.

Outer shell 236 also provides a structural means for permitting the processor 210 to be connected to the inlet pipe 14 and the exhaust pipe 20, typically by welding or clamping. At the same time, outer shell 236 protects the thin-walled inner shell 224 from corrosive effects of the outside atmosphere. Furthermore, outer shell 236 functions to thermally isolate the thin-walled inner shell 224, thereby helping to minimize thermal gradients in the substrate 222 which increase its durability.

The outer shell 236 includes an inlet end 233 that is sized down to surround and mate with the inlet 232 of the thin-walled inner shell 224. The inner shell 224 is thereby cantilevered inside the outer shell 236. The inner shell 224 and outer shell 236 can be welded together at the processor inlet 216 to form an axially extending air gap 238 therebetween. A resilient seal ring 250 of the type commonly used in production resonator construction, is inserted between the inner and outer shells 224, 236 at outlet 234 of the inner shell 224. An example of this type of ring is a wire mesh seal ring called a NAVIN ring. The ring 250 allows for thermal growth between the inner and outer shells 224, 236 while still allowing the outer shell 236 to support the low thermal capacitance, thin-walled inner shell 224. The seal ring 250 provides adequate support for the cantilevered inner shell 224 without generating noise or causing galling of the metal surfaces of shells 224, 236 during heat up and cool down. The seal ring 250 could also be made of an insulating material to further thermally isolate the inner shell 224 from the outer shell 236.

Insulating/support material (not shown) can be inserted in the air gap 238 formed between the inner and outer shells 224, 236, in a fashion similar to that as shown in FIGS. 2 and 3. The insulating material would increase the insulating capability of the processor 210 and provide additional support between the inner and outer shells 224, 236. The air gap 238 and the insulation/support material are isolated from the atmosphere by multiple sizings of the exhaust end 260, 262 of the outer shell 236 which reduce the inner diameter thereof to match the outer diameter of an exhaust pipe 20, and therefore prevent wicking (absorption of water) by the insulation, thereby extending the useful life of the processor 210.

The multiple sizings at the exhaust end of outer shell 236 can be accomplished as follows. For example, the outer shell 236 has a first exhaust sized portion 260 and a second exhaust sized portion 262. The first sized portion 260 is sized down coaxially with the outlet 234 of the thin-walled inner shell 224 to engage the seal ring 250. Downstream from the first exhaust sized portion 260, relative to exhaust gas flow through the exhaust processor 210, the outer shell 236 is sized down at the second sized portion 262. The inner diameter of the second sized portion 262 of the outer shell 236 is equal to the inner diameter of the sized outlet 234 of the inner shell 224. As shown in FIG. 8, the metallic substrate 222 is mounted inside the thin-walled cylindrical tube 224 to partition the tube 224 into an inlet section 225, a substrate mounting section 226, and an outlet section 227.

Although the invention has been described in detail with reference to certain preferred embodiments, variations and modifications exist within the scope and spirit of the invention as described and defined in the following claims.

We claim:

1. An exhaust processor assembly having substrate means for treating emissions contained in combustion product emitted from an engine exhaust, the exhaust processor assembly comprising exhaust pipe means for providing an interior region, second pipe means for providing a passageway receiving combustion product, the substrate means being disposed in the passageway to treat emissions passed therethrough, and means for positioning the second pipe means in the interior region so that thermal transfer between the substrate means and the pipe means is minimized in order to maximize retention of thermal energy by the substrate means resulting from the combustion product traveling through the passageway, the second pipe means including a thin-walled cylindrical member formed to include a notch on one edge and having a tab on another edge sized to fit in the notch to establish a cylindrical shape for the thin-walled cylindrical member.

2. The exhaust processor assembly of claim 1, wherein the thin-walled cylindrical member includes a tubular side wall having a thickness of less than 1.10 mm (0.043 inches).

3. The exhaust processor assembly of claim 1, wherein the second pipe means is configured to wrap around the substrate means to cause the tab to rest inside the notch of the second pipe means and further includes weld means for rigidly joining said one edge formed to include the notch to said another edge having the tab to retain the tab in the notch.

4. An exhaust processor assembly comprising substrate means for treating emissions contained in combustion product emitted from an engine exhaust, inner shell means for providing a passageway receiving combustion product, the inner shell means including a single metal elongated sleeve having an inlet end, an outlet end, and a side wall interconnecting the inlet and outlet ends and surrounding the substrate means, the substrate means having upstream inlet means for admitting combustion product and downstream outlet means for discharging combustion product and being disposed in the passageway to position the upstream inlet means adjacent to the inlet end and the downstream outlet means adjacent to the outlet end and to treat emissions in combustion product passed therethrough, the inner shell means having a thermal capacitance of less than 12,200 Joules per square meter per degree Kelvin, and means for surrounding the inner shell means to maintain the heat provided to the substrate means by the combustion product passing through the passageway at about a predetermined temperature, the surrounding means including an outer shell around and along the inner shell means and means for mounting the outer shell to the inner shell means to establish a closed volume space around and along the inner shell means so that an insulative air gap surrounds the inner shell means and a portion of the closed volume space lies between the inlet end of the single metal elongated sleeve and the upstream inlet means of the substrate means.

5. The exhaust processor assembly of claim 4, further comprising means for positioning the inner shell means inside the surrounding means in spaced-apart relation to the outer shell to maximize retention of heat by the substrate means resulting from the heated combustion product traveling through the passageway.

6. The exhaust processor assembly of claim 4, wherein the surrounding means further includes a circumferential seal ring fixedly fixed the outer shell and the inner shell means to define one boundary of the closed volume space provided between the outer shell and the inner shell means.

7. The exhaust processor assembly of claim 4, further comprising insulating material disposed in the closed volume to increase the insulating capability of the air gap.

8. An exhaust processor assembly comprising substrate means for treating emissions contained in combustion product emitted from an engine exhaust, inner shell means for providing a passageway receiving combustion product, the inner shell means including an inlet end and an outlet end, the substrate means having upstream inlet means for admitting combustion product and downstream outlet means for discharging combustion product being disposed in the passageway to position the upstream inlet means adjacent to the inlet end and the downstream outlet means adjacent to the outlet end and to treat emissions in combustion product passed therethrough, the inner shell means having a thermal capacitance of less than 12,200 Joules per square meter per degree Kelvin, means for surrounding the inner shell means to maintain the heat provided to the substrate means by the combustion product passing through the passageway at about a predetermined temperature, the surrounding means including an outer shell around and along the inner shell means and means for mounting the outer shell to the inner shell means to establish a closed volume space around and along the inner shell means so that an insulative air gap surrounds the inner shell means and a portion of the closed volume space lies between the inlet end of the thin-walled inner shell and the upstream inlet means of the substrate means, the inner shell means including a thin-walled cylindrical member formed to include a notch on one edge and having a tab on another edge sized to fit in the notch to establish a cylindrical shape for the thin-walled cylindrical member.

9. The exhaust processor assembly of claim 8, wherein the inner shell means is configured to wrap around the substrate means to cause the tab to rest inside the notch of the inner shell means and further includes weld means for rigidly joining said one edge formed to include the notch to said another edge having the tab to retain the tab in the notch.

10. The exhaust processor assembly of claim 4, wherein the inner shell means includes a thin-walled inner shell having a tubular side wall with a thickness of less than 1.10 mm (0.043 inches).

11. An exhaust processor assembly comprising a thin-walled inner shell receiving hot combustion product from the engine and having a thermal capacitance of less than 12,200 Joules per square meter per degree Kelvin, the thin-walled inner shell having an inlet end, an outlet end, and a cylindrical sleeve interconnecting the inlet and outlet ends, substrate means for treating emissions contained in combustion product emitted from an engine, the substrate means having upstream inlet means for admitting combustion product from the engine and downstream outlet means for discharging combustion product and being positioned inside the cylindrical sleeve of the thin-walled inner shell to locate the upstream inlet means adjacent to the inlet end and the downstream outlet means adjacent to the outlet end, and an outer shell surrounding the thin-walled inner shell, the thin-walled inner shell being coupled to the outer shell to create an annular space around and along the thin-walled inner shell and inside the outer shell in an upstream position located inside the outer shell between the inlet end of the thin-walled inner shell and the upstream inlet means of the substrate means.

12. The assembly of claim 11, wherein the thin-walled inner shell includes a tubular side wall having a wall thickness of less than 1.1 mm (0.043) inches.

13. The processor assembly of claim 11, wherein the outer shell includes a tubular side wall having a thickness of more than 1.10 mm (0.043 inches), the outer shell being in spaced-apart relation to the thin-walled inner shell.

14. The processor assembly of claim 11, wherein the thin-walled inner shell is made of stainless steel.

15. The processor assembly of claim 11, wherein the thin-walled inner shell has a wall thickness of less than 1.1 mm (0.043 inches) and the outer shell has a side wall with a thickness of greater than 1.1 mm (0.043 inches).

16. The exhaust processor assembly of claim 4, wherein another portion of the closed volume space lies between the outlet end of the thin-walled inner shell and the downstream outlet means of the substrate means.

17. The exhaust processor assembly of claim 4, wherein the inner shell means includes a first cylindrical portion defining the inlet end and having a first diameter, a second cylindrical portion containing the substrate means and having a second diameter larger than the first diameter, and a diverging flared portion interconnecting the first and second cylindrical portions, and the flared portion of the inner shell means cooperates with an adjacent portion of the outer shell to define said portion of the closed volume space.

* * * * *